US011457754B1

(12) United States Patent
Adelipour et al.

(10) Patent No.: US 11,457,754 B1
(45) Date of Patent: Oct. 4, 2022

(54) METHOD AND APPARATUS FOR SUPPORTING A CHILD'S HEAD

(71) Applicant: Justin Adelipour, New York, NY (US)

(72) Inventors: Justin Adelipour, New York, NY (US); Catalina Navarro, Aurora (CA); Lara Clair, Stouffville (CA); Bartek Zalewski, Richmond Hill (CA)

(73) Assignee: Justin Adelipour, New York, NY (US)

( * ) Notice: Subject to any disclaimer, the term of this patent is extended or adjusted under 35 U.S.C. 154(b) by 0 days.

(21) Appl. No.: 17/586,403

(22) Filed: Jan. 27, 2022

(51) Int. Cl.

| | |
|---|---|
| ***A47G 9/10*** | (2006.01) |
| ***A47D 13/08*** | (2006.01) |
| ***A47C 7/38*** | (2006.01) |
| *A41D 1/215* | (2018.01) |

(52) U.S. Cl.
CPC ..... *A47G 9/1081* (2013.01); *A47C 7/383* (2013.01); *A47D 13/08* (2013.01); *A47G 9/1045* (2013.01); *A41D 1/215* (2018.01)

(58) Field of Classification Search
CPC ..... A47G 9/1081; A47G 9/10; A47C 7/383; A47C 7/38; A47D 13/08; A47D 13/083; A41D 13/0512; A41D 13/0518; A41B 13/10; A41B 13/103; A41B 13/106
USPC ..... 5/655, 652, 640, 636; 2/459, 461, 463, 2/46, 48, 49.1, 49.2, 49.3
See application file for complete search history.

(56) References Cited

U.S. PATENT DOCUMENTS

| | | | | | |
|---|---|---|---|---|---|
| 2,258,946 | A * | 10/1941 | Chadwick | A41B 13/10 | 2/48 |
| 2,482,182 | A * | 9/1949 | Henninger | A41D 1/215 | 2/48 |
| 2,765,480 | A * | 10/1956 | Mueller | A47C 7/425 | 5/636 |
| 2,857,599 | A * | 10/1958 | Wallace | A41D 1/215 | 2/48 |
| 2,952,856 | A * | 9/1960 | Ruff | A47G 9/10 | D6/716.3 |
| 3,327,330 | A * | 6/1967 | McCullough | A47G 9/10 | 5/636 |
| 4,617,691 | A * | 10/1986 | Monti | A47C 7/383 | 5/636 |
| 4,646,374 | A * | 3/1987 | Shafer | A47C 7/029 | 5/653 |

(Continued)

FOREIGN PATENT DOCUMENTS

| | | | | |
|---|---|---|---|---|
| GB | 2198341 A * | 6/1988 | ..... | A47C 7/383 |
| WO | WO-2019113250 A1 * | 6/2019 | ..... | A47C 7/383 |

*Primary Examiner* — Robert G Santos
(74) *Attorney, Agent, or Firm* — Sand, Sebolt & Wernow Co., LPA

(57) ABSTRACT

A pillow that is worn on a body of a parent or caregiver to support the head of an infant or young child. The pillow includes a U-shaped shell having a central region and first and second legs that extend outwardly from opposite ends of the central region in a same direction as one another. A gap is bounded and defined the first leg, the central region, and the second leg. When the pillow is worn, the central region rests behind the parent or caregiver's neck and one of the first and second legs extends over each shoulder and onto their chest. Closure tabs secure the legs to one another. A separate pad is removably received within each of the first leg and the second leg. The central region is made up of two layers of fabric and is free of any pads or filler materials.

23 Claims, 12 Drawing Sheets

(56) References Cited

U.S. PATENT DOCUMENTS 4,697,287 A * 10/1987 Rose ..... A41D 1/215 2/48
4,873,725 A * 10/1989 Mitchell ..... A41D 13/04 2/48
5,005,217 A * 4/1991 Bern ..... A41D 1/215 2/48
5,111,544 A * 5/1992 Graebe ..... A47C 7/021 5/490
5,182,828 A * 2/1993 Alivizatos ..... A47D 15/008 5/655
5,709,000 A * 1/1998 Hansen ..... A41D 1/215 5/655
5,864,904 A * 2/1999 Rudick ..... A47G 9/10 5/636
5,950,235 A * 9/1999 Tata ..... A41D 1/215 2/48
5,960,471 A * 10/1999 Burton ..... A41D 1/215 2/48
6,000,664 A * 12/1999 Hood ..... A61J 9/0638 248/104
6,345,392 B1 * 2/2002 Rios ..... A41B 13/10 2/48
6,347,421 B1 * 2/2002 D'Emilio ..... A47C 7/383 5/636
6,641,220 B2 * 11/2003 Clegg ..... A47C 7/383 5/636
6,886,201 B1 * 5/2005 Weiss-Lohrei ..... A47C 20/021 5/490
6,990,686 B2 * 1/2006 Palmer ..... A41D 13/04 2/92
D522,300 S * 6/2006 Roberts ..... A47C 7/383 D6/601
7,082,617 B1 * 8/2006 Poindexter ..... A41D 1/215 2/48
D547,586 S * 7/2007 Weiss-Lohrei ..... B60N 2/7005 D6/601
7,322,061 B2 * 1/2008 Carroll ..... A47D 13/083 5/640
7,350,252 B2 * 4/2008 Telegadis ..... A47D 5/006 5/733
7,640,598 B1 1/2010 Mallik
7,694,371 B2 * 4/2010 Telegadis ..... A47D 5/006 5/655
D636,152 S * 4/2011 Wilson Watkins ..... D2/861
D684,725 S * 6/2013 Kuever ..... D29/101.2
D684,726 S * 6/2013 Kuever ..... D29/101.2
D684,727 S * 6/2013 Kuever ..... D29/101.2
8,683,614 B2 4/2014 Leung et al.
8,707,467 B2 * 4/2014 Sohn ..... A41D 1/215 2/48
8,973,163 B1 * 3/2015 Kuever ..... A41D 1/215 2/46
9,021,635 B1 * 5/2015 Leach ..... A47C 20/021 5/632
9,259,091 B2 * 2/2016 Freund ..... A47C 7/383
10,021,949 B2 * 7/2018 Cooper ..... A45F 3/14
D835,431 S * 12/2018 Bice ..... D6/601
10,702,035 B2 * 7/2020 Cooper ..... A45F 4/02
11,330,921 B2 * 5/2022 Bice ..... A47G 9/10
2002/0113482 A1 * 8/2002 Clegg ..... A47C 7/383 297/391
2004/0025220 A1 * 2/2004 Palmer ..... A41D 1/215 2/93
2004/0172763 A1 * 9/2004 Sachs ..... A47C 3/16 5/652
2005/0066405 A1 * 3/2005 Babiak ..... A41D 13/04 2/48
2005/0173962 A1 * 8/2005 Stein ..... B60N 2/7005 297/397
2006/0031992 A1 * 2/2006 Moore ..... A47C 20/021 5/630
2006/0282953 A1 * 12/2006 Telegadis ..... A47D 5/006 5/655
2007/0180623 A1 * 8/2007 Stein ..... A47C 7/383 5/640
2007/0209115 A1 * 9/2007 Carroll ..... A47C 20/027 5/636
2008/0209640 A1 * 9/2008 Telegadis ..... A47D 5/006 5/655.9
2008/0263740 A1 * 10/2008 Wright ..... A41D 1/215 2/49.1
2010/0037395 A1 2/2010 Heeter
2012/0284893 A1 * 11/2012 Sohn ..... A41D 1/215 2/46
2013/0205463 A1 * 8/2013 Leung ..... A41B 13/10 2/48
2015/0013071 A1 * 1/2015 Freund ..... A47C 7/383 5/639
2016/0045008 A1 * 2/2016 Cooper ..... A47C 7/383 224/577
2016/0045036 A1 2/2016 Huljev
2019/0008255 A1 * 1/2019 Cooper ..... A45F 3/14
2019/0167020 A1 * 6/2019 Bice ..... A47C 7/425

* cited by examiner

METHOD AND APPARATUS FOR SUPPORTING A CHILD'S HEAD

TECHNICAL FIELD

This disclosure is directed to childcare equipment. More particularly, this disclosure relates to equipment helpful for caregivers when caring for infants and young children. Specifically, the disclosure is directed to a support pillow which is wearable by a caregiver around the neck and over both shoulders in order to provide comfortable support for a young child's head when the child is being held by the caregiver.

BACKGROUND

Parents and caregivers of infants and young children frequently will hold the infant or child in their arms in such a way that the child's head rests on the parent or caregiver's chest and/or shoulder. The child's body rests against the parent or caregiver's chest and abdomen. This arrangement may become quite uncomfortable for the child and parent or caregiver after some time, particularly if the child falls asleep. Additionally, if the child is an infant, there is a chance that after feeding, the infant may spit up on the parent or caregiver's clothing.

Several wearable pillows have been proposed in the prior art to provide a more comfortable spot for a child to rest their head while being held. Mallik (U.S. Pat. No. 7,640,598), for example, discloses a bib-like pillow garment. The bib portion covers the chest of the parent or caregiver and part of both shoulders. A first end of a strap is secured to one of the shoulder regions of the bib and a second end of the strap is secured to a bottom region of the bib on the same side as that shoulder region. The parent or caregiver can slip the bib-like pillow garment on by extending one arm through the loop defined by the strap and the bib and then moving the free shoulder region onto their other shoulder. One of the issues with this bib-like pillow garment is that there may be a tendency of the bib to become skewed or slide off the parent or caregiver's body because nothing is really holding the bib-like garment onto their torso.

Leung et al. (U.S. Pat. No. 8,683,614) discloses a pillow bib that fits over only one shoulder of the parent or caregiver. Like the Mallik device, the Leung et al. pillow bib includes a strap. Unlike the Mallik bib-like garment, the strap on the Leung et al. pillow bib wraps around the torso of the parent or caregiver and passes under the arm opposite from the shoulder upon which the pillow bib is worn. This arrangement helps to ensure the pillow bib has less of a tendency to skew or slide off the parent or caregiver's body. The arrangement, however, makes the pillow bib quite difficult to put on or take off unless the parent or caregiver has both hands free. One of the disadvantages of the Leung et al. pillow bib is that because the device only extends over one shoulder, if the parent or caregiver wants to switch the position of the child's head and body to their other shoulder, there is no part of the pillow bib on the other shoulder.

Heeter (U.S. Patent Application Publication No. 2010/0037395) discloses a pillow that defines a U-shaped recess in its lower surface. The pillow can be placed on one shoulder of a parent or caregiver such that their shoulder is received into the U-shaped recess of the pillow. The shape of the recess is relied upon to keep the pillow in place on the parent or caregiver's body. If the parent or caregiver wishes to switch the child's head and body to the parent's other shoulder, the pillow has to be removed from the parent's first shoulder and placed on their second shoulder before the position of the child can be changed.

Huljev (U.S. Patent Application Publication No. 2016/0045036) discloses a crescent shaped pillow for supporting an infant or young child's head. The pillow is disclosed as being filled with buckwheat and is wrapped around the parent's neck so that a portion of the pillow passes over each shoulder and onto the parent's chest. The regions of the pillow that extend over the shoulders and onto the parent's chest taper in diameter moving from the neck portion to the free ends of the pillow. The free ends are able to be secured to one another to keep the pillow engaged with the parent's body. The disadvantages of this pillow are that the region passing around the parent's neck is of the greatest diameter and therefore will do more to support the parent's neck than the child's head. The pillow provides some versatility in that it can be used to encircle a child's body and be used to help prop a young child into a seated position. In this instance, the larger diameter middle region of the pillow that could be passed around the parent's neck if worn on the body, will later form the part of the pillow that will support the young child's back when seated on the floor.

SUMMARY

A support pillow is disclosed herein. The pillow is worn on a body of a parent or caregiver to support the head of an infant or young child. The pillow is comprised of a U-shaped shell having a central region and first and second legs that extend outwardly from opposite ends of the central region in a same direction as one another. A gap is bounded and defined the first leg, the central region, and the second leg. When the pillow is worn, the central region rests behind the parent or caregiver's neck and one of the first and second legs extends over each shoulder and onto the parent or caregiver's chest. Closure tabs secure the legs to one another. A separate pad is removably received within each of the first leg and the second leg. The central region is made up of two layers of fabric and is free of any pads or filler materials.

In one aspect, an exemplary embodiment of the present disclosure may provide a child head support pillow comprising a shell that is U-shaped and comprises a central region, a first leg, and a second leg, wherein the first leg and second leg extend outwardly from opposite ends of the central region and in a same direction as one another; a gap bounded and defined by an inner surface of the first leg, an inner surface of the central region, and an inner surface of the second leg; and a separate pad received within each of the first leg and the second leg.

In one embodiment, the central region may comprise a first layer and a second layer that are opposed to one another. In one embodiment, the central region may comprise a first layer and a second layer that are located in abutting contact with one another. In one embodiment, the central region may comprise a first layer and a second layer; wherein a cavity is defined between an interior surface of the first layer and an interior surface of the second layer, and the cavity is empty. In one embodiment, the central region may be separated from each of the first leg and the second leg by a row of stitches, and a thickness of the central region may be less than the thickness of each of the first leg and the second leg, where the thickness of the central region is measured between a first layer and a second layer of the central region.

In one embodiment, the first leg and the second leg may be substantially equal in length and extend beyond the central region. In one embodiment, the shell may have a first end and a second end opposed to the first end and wherein the shell tapers in width moving in a direction from the second end and towards the first end. In one embodiment, the first leg has an inner end, the central region may have an inner end, and the second leg has an inner end, and the inner ends of the first leg, central region, and second leg are substantially continuous, and wherein the pillow may include a first closure member provided on the first leg adjacent the inner end thereof; and a second closure member is provided on the second leg adjacent the inner end thereof; and wherein the first closure member and second closure member operatively engage one another to secure the first leg and second leg to one another.

In one embodiment, the first leg may have a first surface and a second surface opposed to the first surface, and the second may be is adapted to contact a body of a caregiver wearing the pillow, and wherein a portion of the second surface of one or both of the first leg and the second leg may include a friction-increasing region. In one embodiment, the pillow may further comprise a loop member provided on one of the first leg and the second leg, and the loop member may be adapted to selectively secure an object to the pillow. In one embodiment, the shell may be manufactured from a washable fabric material. In one embodiment, the washable fabric material may be cut off grain. In one embodiment, the first leg and the second leg may each define an interior compartment and each pad may be removably received within the interior compartment of one or the other of the first leg and the second leg. In one embodiment, a portion of each of the first leg and the second leg may be comprised of a first fabric section and a second fabric section that partially overlap one another, and wherein an access opening may be defined between the overlapped portion of the first fabric section and the second fabric section, and wherein the access opening may be in fluid communication with an interior compartment defined in the respective first leg and second leg.

In one embodiment, each pad may include a first surface and a second surface opposed to the first surface; a first end and a second end opposed to the first end; and wherein the first surface and second end may be shived to form an angular portion. In one embodiment, the angular portion may be arranged at an angle of about 45° relative to the second surface of the pad. In one embodiment, each pad may include a first surface and a second surface opposed to the first surface; a first end and a second end extending between the first surface and second surface and defining a longitudinal direction therebetween, and a first side and a second side defining a lateral direction therebetween; and wherein the pad further comprises at least one row of stitching that extends from the first side to the second side of the pad and reduced a distance between the first surface and the second surface. In one embodiment, the at least one row of stitching may comprise a first row of stitching disposed a distance away from the first end of the pad; and wherein the first row of stitching may form a first bending zone of the pad. In one embodiment, the at least one row of stitching further may comprise a second row of stitching disposed a distance away from the first row of stitching moving in a direction away from the first end of the pad and towards the second end of the pad; and wherein the second row of stitching may form a second bending zone of the pad.

In another aspect, an exemplary embodiment of the present disclosure may provide a method of supporting a child's head while the child is being held by a caregiver, said method comprising placing a head support pillow on the caregiver's body by placing a central region of the head support pillow behind the caregiver's neck; extending a first leg of the head support pillow over a first shoulder of the caregiver's body; extending a second leg of the head support pillow over a second shoulder of the caregiver's body; extending the first leg and the second leg downwardly over portions of the caregiver's chest in such a way that the first leg is laterally spaced from the second leg; engaging a first closure member on the first leg with a second closure member on the second leg such that a gap between a lowermost end of the first leg and a lowermost end of the second leg is reduced; and placing a head of the child on one or the other of the first leg and the second leg.

In one embodiment, the method may further comprise draping an uppermost end of the head support pillow over the caregiver's shoulders in an opposite direction to the direction in which the first leg and the second leg extend. In one embodiment, the method may further comprise contacting a portion of the caregiver's body with a non-slip surface provided on one or both of the first leg and the second leg.

BRIEF DESCRIPTION OF THE SEVERAL VIEWS OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Referring to FIGS. 1 through 9B, an apparatus for supporting a head of an infant or young child in accordance with an aspect of the present disclosure is illustrated, generally indicated at 10. Apparatus 10 is configured in such a way as to be worn on the body of a parent or caregiver and is useful for supporting the head of the infant or young child particularly when being held by the parent or caregiver. The contours of the human shoulder may be too hard for the infant or young child's head to rest comfortably thereon. Pillow 10 includes memory foam which provides a soft, comfortable surface for the infant to rest his or her head. The softness of pillow 10 allows the baby to fall asleep faster and also provides greater comfort to the parent or caregiver while holding the child.

Figure 10:
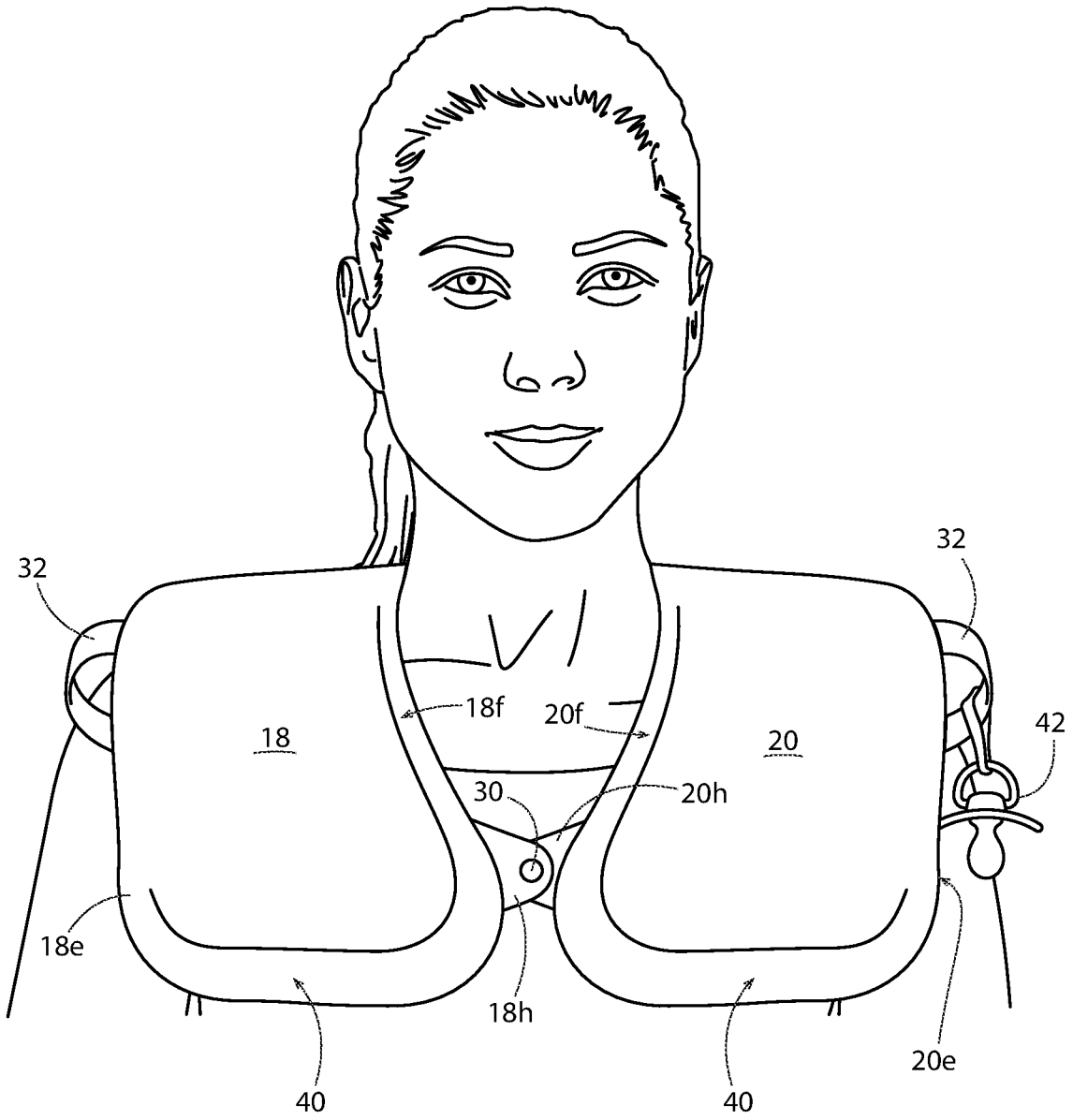
FIG. 10 is a front elevation view showing the head support pillow worn on a caregiver's body.
Figure 11:
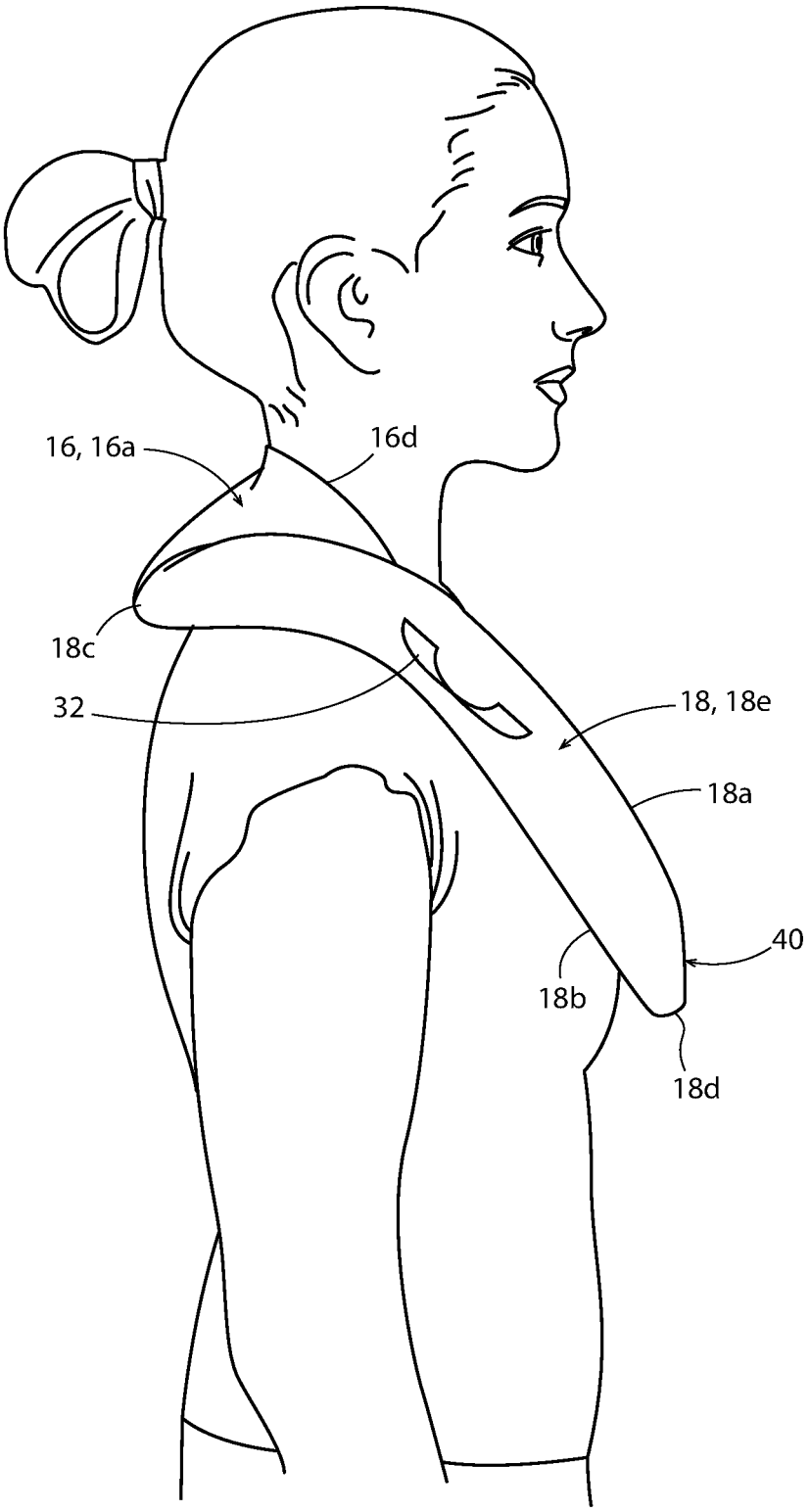
FIG. 11 is a left-side elevation view of the head support pillow worn on the caregiver's body.
Figure 12:
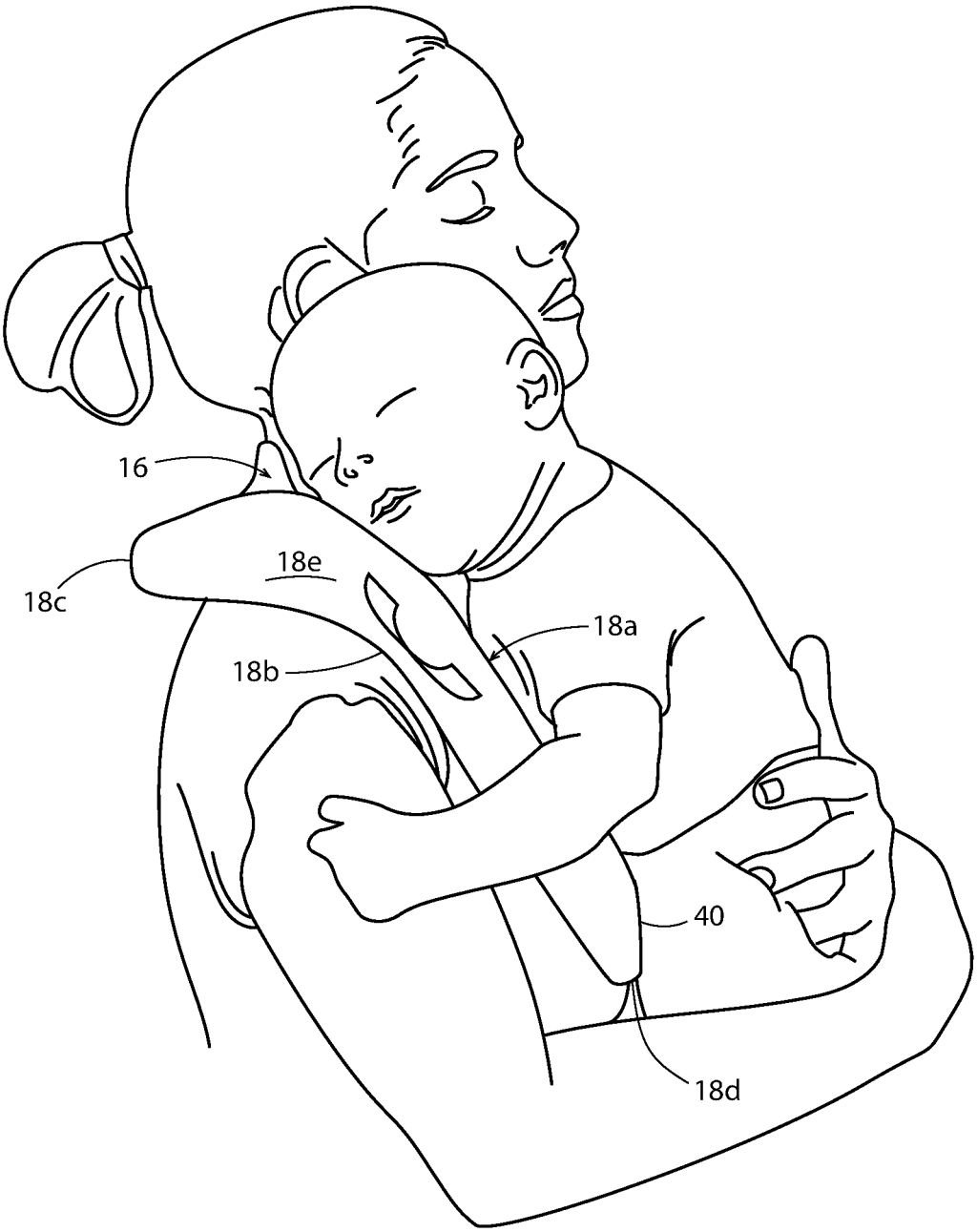
FIG. 12 is a left side elevation view of the head support pillow being used to support the head of an infant thereon.

The apparatus 10 will be referred to hereinafter as "pillow 10", the infant or young child may be referred to hereinafter by the term "child", and the parent or caregiver may be referred to herein by the term "parent". FIGS. 10 through 12 show pillow 10 in use.

Figure 1:
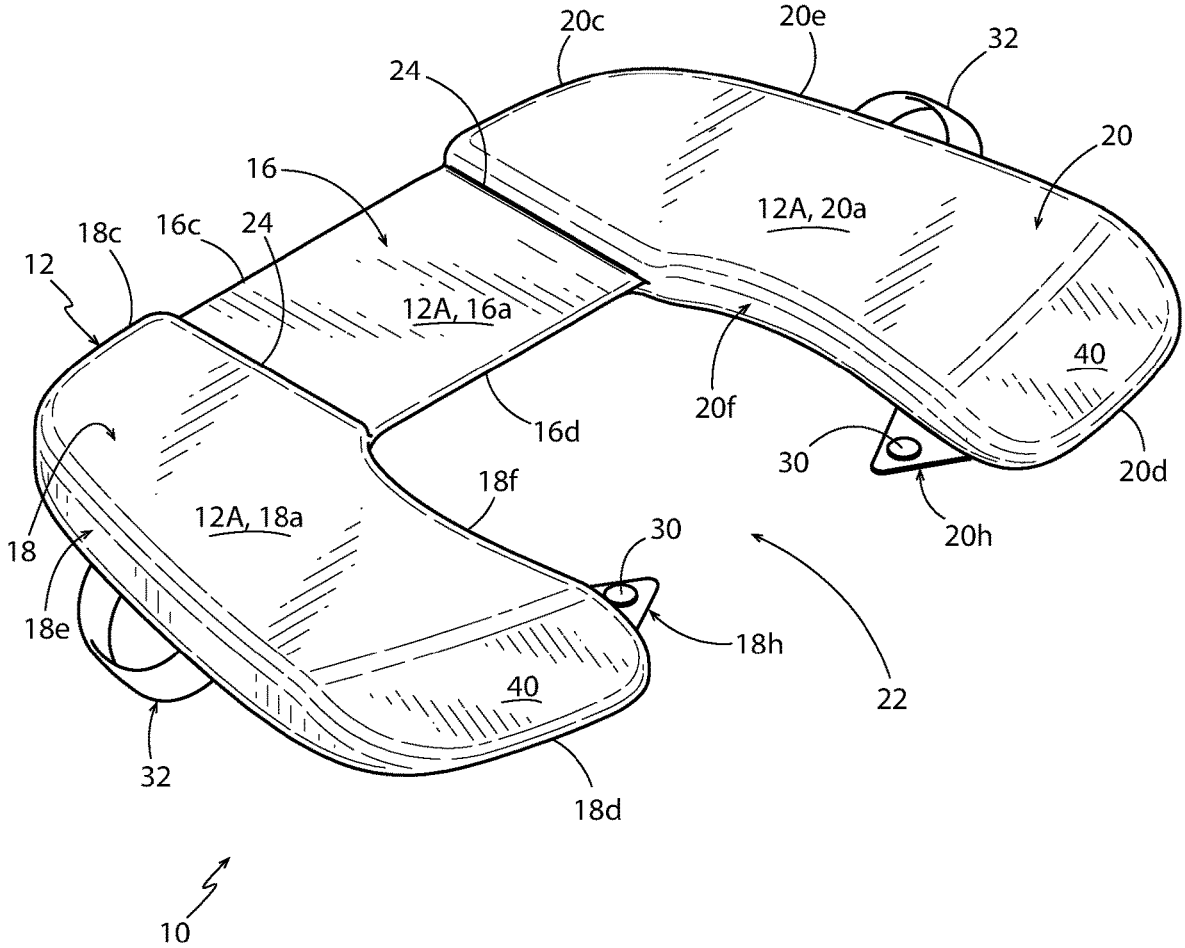
FIG. 1 is top, front, left side perspective view of a head support pillow in accordance with the present disclosure.
Figure 2:
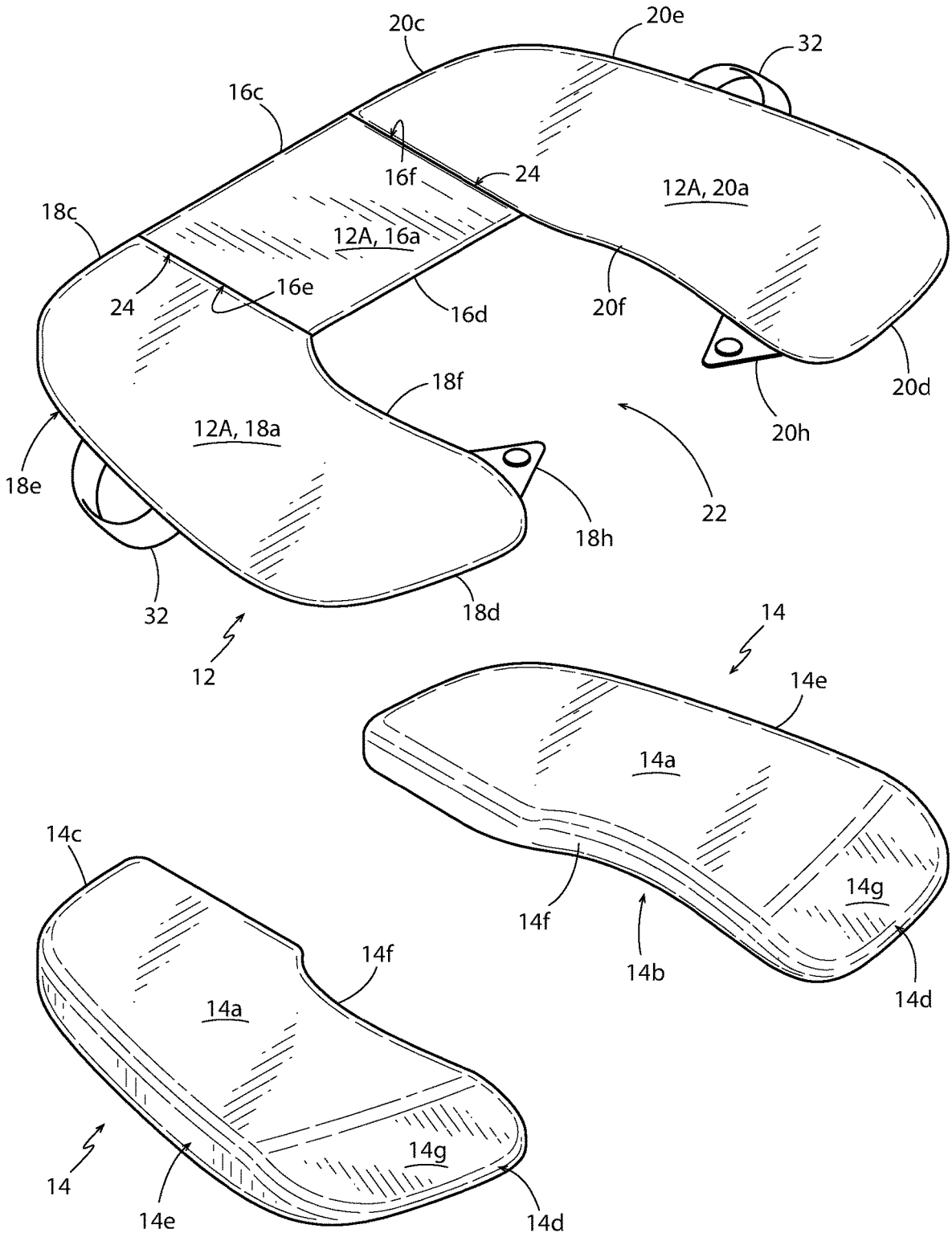
FIG. 2 is an exploded bottom, front, left side perspective view of the head support pillow of FIG. 1.

Referring to FIGS. 1 and 2, pillow 10 will be described in detail. Pillow 10 is comprised of a shell 12 and a pair of pads 14. Shell 12 is configured to be U-shaped when viewed from above, as in FIG. 2, and is manufactured from a washable fabric. The washable fabric preferably is cut "off grain", i.e., on the diagonal or the bias. Because of this cutting orientation, the fabric of shell 12 is capable of stretching to a greater degree than if the fabric was cut on grain, i.e., parallel to the warp threads. The fabric of shell is also capable of stretching to a greater degree than if the fabric was cut at right angles to the grain, i.e., parallel to the weft threads of the fabric. The stretchability of the fabric of shell 12 makes it easier to insert pads 14 into the shell 12 and to remove pads 14 from shell 12, as will be later described herein. The stretchability of the fabric of shell 12 also allows for greater flexing of the pads 14 and shell fabric when a child's head is placed onto pillow 10.

While it will be understood that cutting the fabric of shell 12 off grain produces the best results in the functionality of pillow 10, in other embodiments the fabric of shell 12 may be cut parallel to the warp or parallel to the weft of the fabric and the pillow will still function as disclosed herein.

As indicated above, shell 12 is U-shaped and is arranged as a central region 16, a first leg 18, and a second leg 20. First leg 18 and second leg 20 extend outwardly from opposite ends of the central region 16 in a same direction. A gap 22 is defined between first leg 18 and second leg 20. The fabric used to form shell 12 is cut from a pattern and is then stitched together in any suitable manner to produce the desired shape and features described herein. In particular, the fabric used to form shell 12 will ultimately be arranged to provide a first layer 12A of shell 12 and a second layer 12B thereof. In use, the second layer 12B of shell 12 is placed on the body of the parent and the child is placed in contact with the first layer 12A. As such, the first layer 12A of the shell 12 may also be referred to as the "upper layer" or "outer layer" of shell 12, and the second layer 12B of shell 12 may also be referred to as the "lower layer" or "inner layer" of the shell 12.

Figure 7:
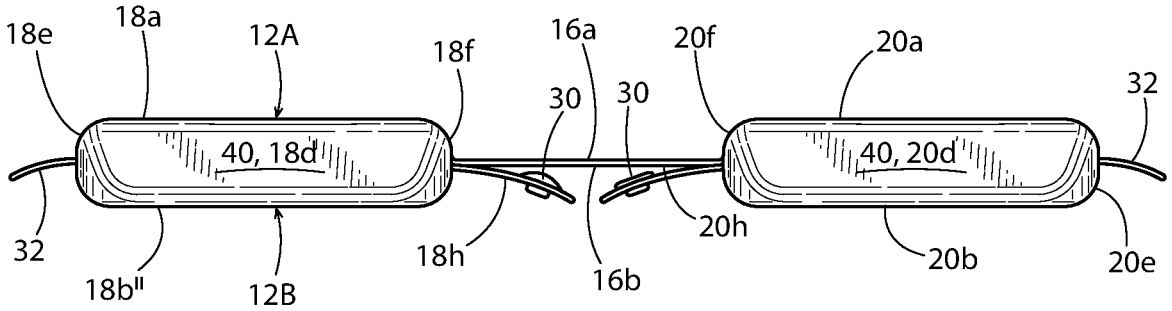
FIG. 7 is a front elevation view thereof.
Figure 8:
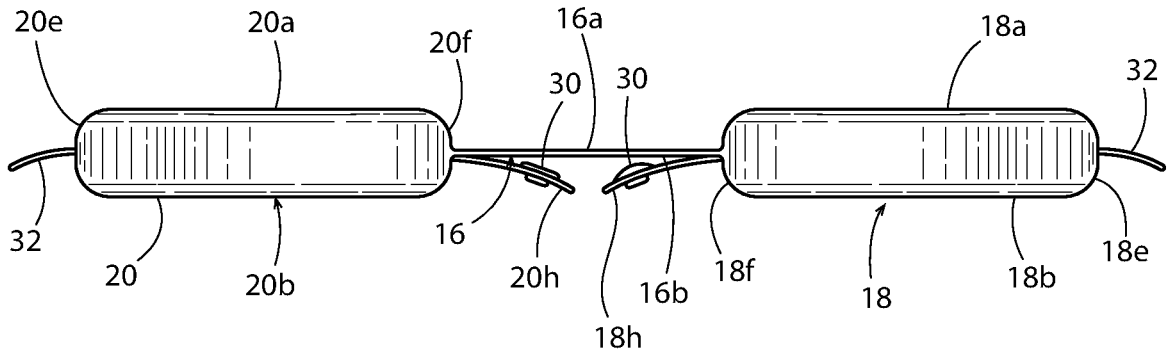
FIG. 8 is a rear elevation view thereof.

Referring particularly to FIGS. 2, 7 and 8, central region 16 includes a first layer 16*a* and a second layer 16*b* that are arranged one above the other and the inner surface of the first layer 16*a* is opposed to the inner surface of second layer 16*b*. The first layer 16*a* and second layer 16*b* preferably are in direct abutting contact with one another or are in close proximity to one another. A cavity may be defined between the inner surface of first layer 16*a* and the inner surface of second layer 16*b* but the cavity is empty. In some embodiments, a thin layer of padding may be interposed between first layer 16*a* and second layer 16*b* but preferably such thin layer of padding is omitted from central region 16.

Figure 3:
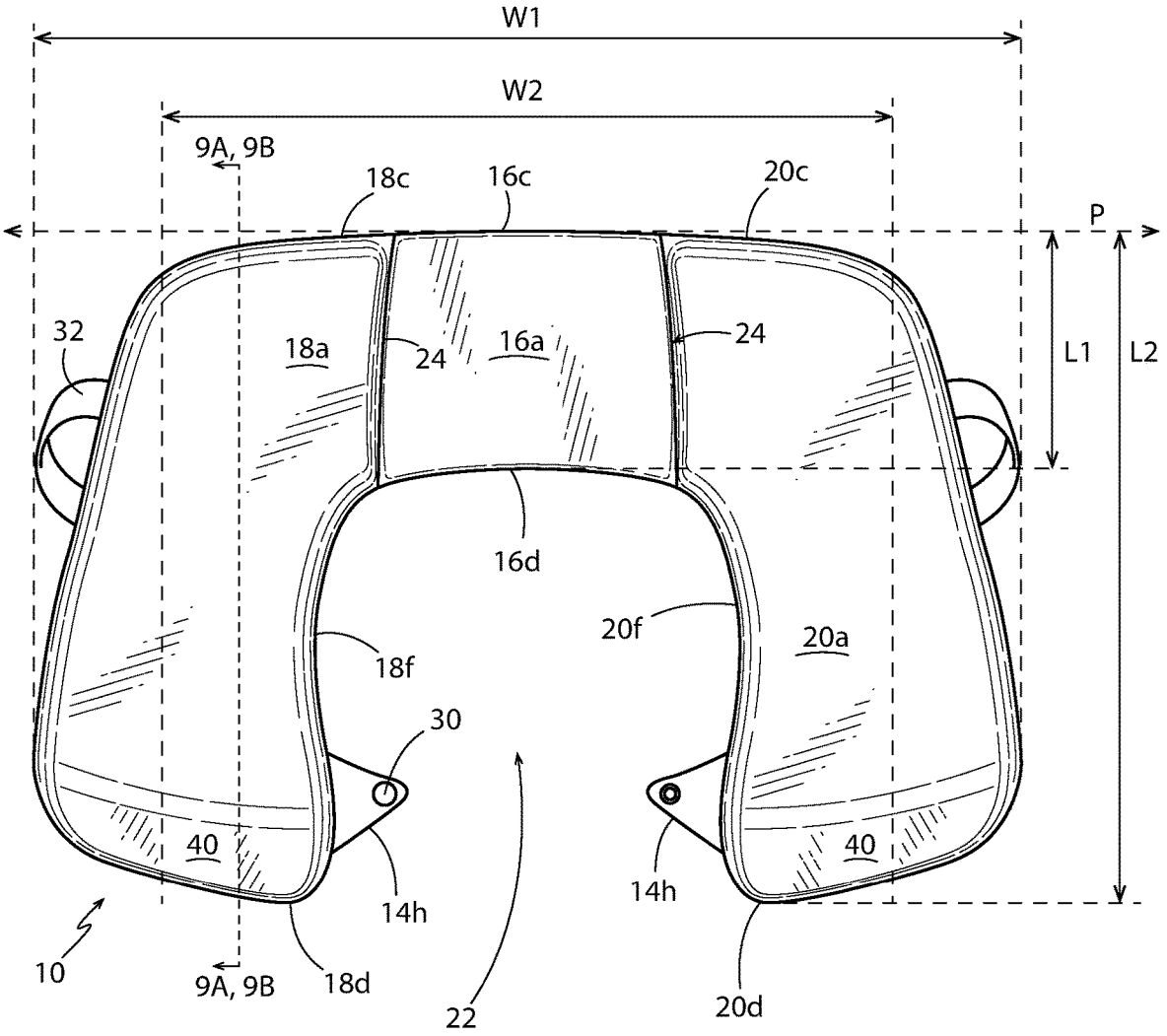
FIG. 3 is a top plan view thereof.

The central region 16 has a first end 16*c*, a second end 16*d*, a first side 16*e*, and a second side 16*f*. FIG. 3 shows that a line of stitches 24 joins first layer 16*a* to second layer 16*b* of central region 16. One line of stitches 24 also separates central region 16 from first leg 18 and another line of stitches 24 separates central region 16 from second leg 20.

Figure 4:
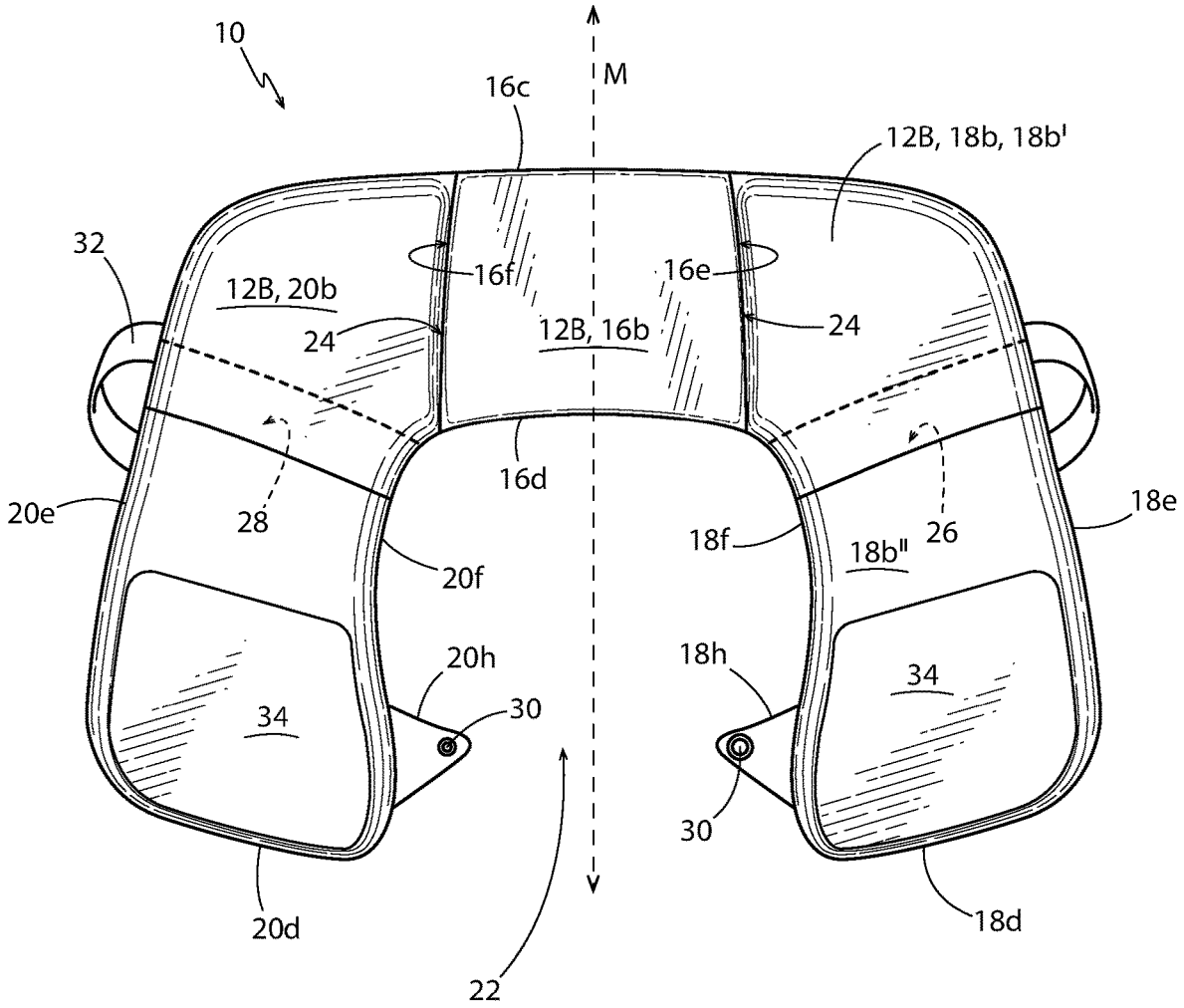
FIG. 4 is a bottom plan view thereof.
Figure 5:
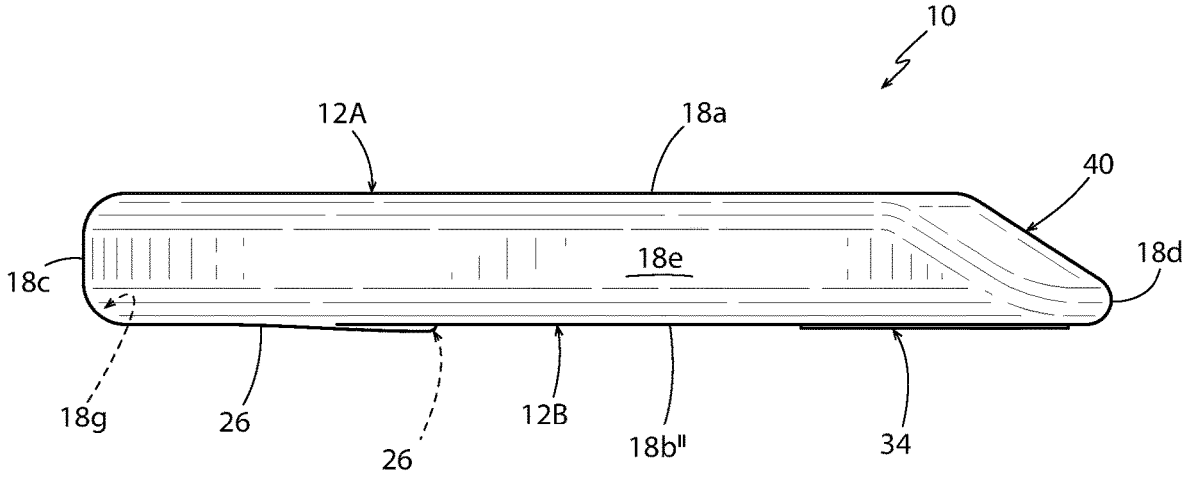
FIG. 5 is a left side elevation view thereof.
Figure 6:
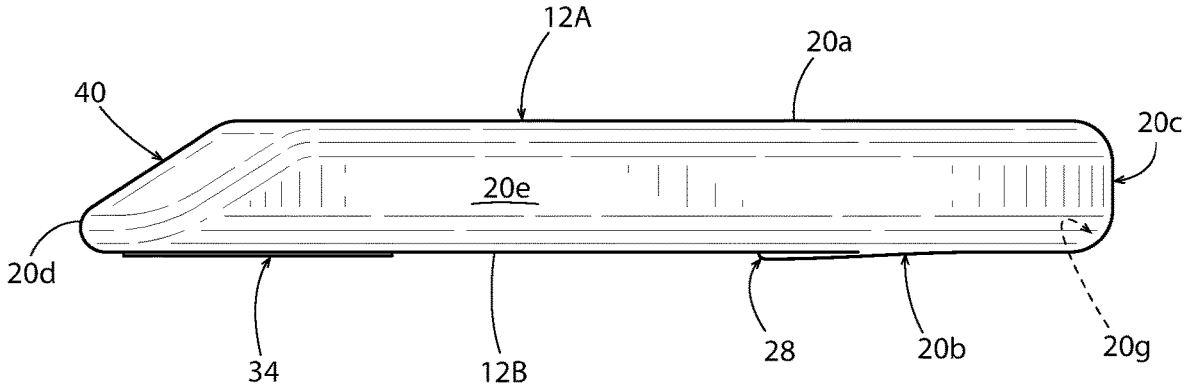
FIG. 6 is a right side elevation view thereof.

As indicated earlier herein, first leg 18 and second leg 20 extend outwardly from opposite ends of central region 16 in generally a same direction. First leg 18 and second leg 20 tend to flare outwardly away from one another moving outwardly from central region 16. FIG. 4 shows that pillow 10 has an imaginary midline "M" that is located centrally within central region 16 and is oriented at right angles to first end 16*c* of central region 16. In pillow 10, first leg 18 and second leg 20 are arranged as mirror images of one another about imaginary midline "M". It should be noted that pillow 10 is symmetrical about midline "M" and that first leg 18 and second leg 20 are of generally a same length.

Figure 9A:
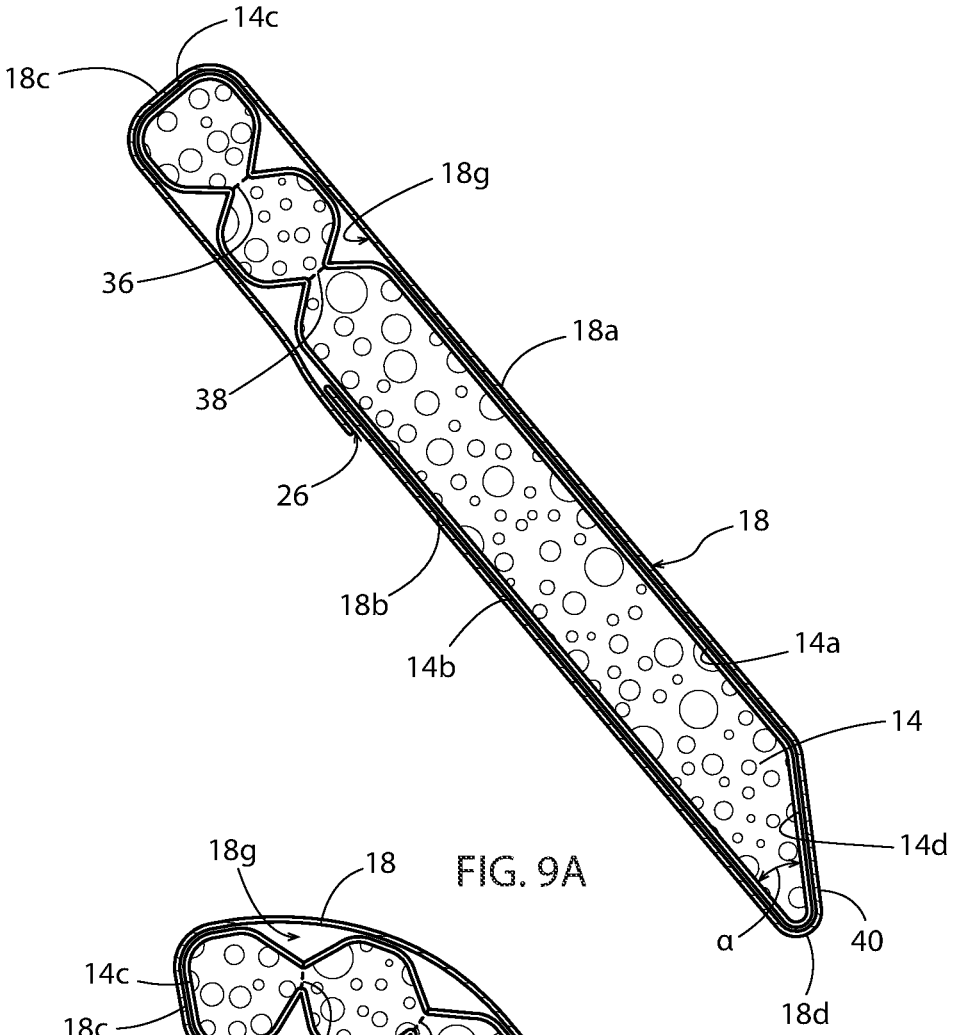
FIG. 9A is a cross-section of the head support pillow taken along line 9A-9A of FIG. 3, where the head support pillow is shown prior to use.

First leg 18 is described in greater detail hereafter but it will understood that the second leg 20 is identically configured and is arranged as a mirror image of first leg 18. First leg 18 is comprised of a first wall 18*a*, a second wall 18*b*, a first end 18*c*, a second end 18*d*, a first side 18*e*, and a second side 18*f*. First wall 18*a* is opposed to second wall 18*b*, first end 18*c* is opposed to second end 18*d*, and first side 18*e* is opposed to second side 18*f*. First wall 18*a*, second wall 18*b*, first end 18*c*, second end 18*d*, first side 18*e*, and second side 18*f* bound and define an interior compartment 18*g* (FIG. 9A). Second leg 20 is comprised of a first wall 20*a*, a second wall 20*b*, a first end 20*c*, a second end 20*d*, a first side 20*e*, and a second side 20*f*. First wall 20*a*, second wall 20*b*, first end 20*c*, second end 20*d*, first side 20*e*, and second side 20*f* bound an define an interior compartment 20*g* (FIG. 6) identical to interior compartment 18*g*.

Figure 9B:
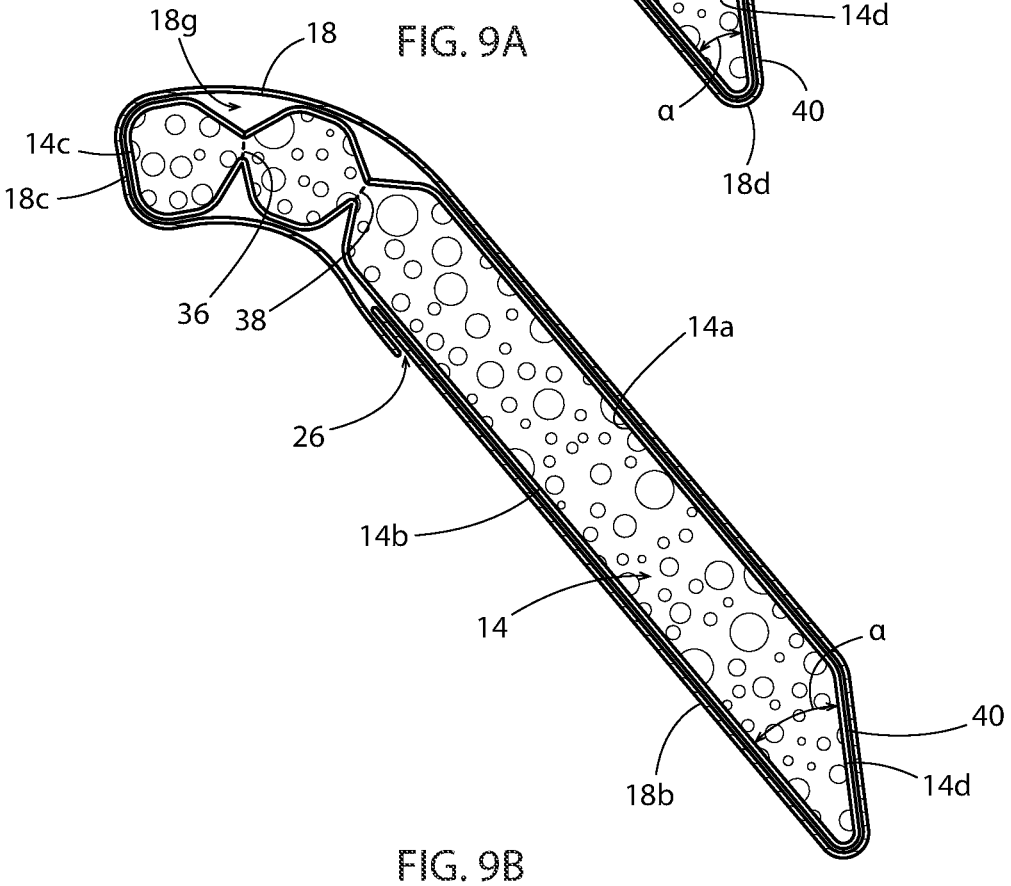
FIG. 9B is a cross-section of the head support pillow taken along line 9B-9B of FIG. 3, where the head support pillow is shown during use.

As best seen in FIGS. 2, 9A, and 9B, second layer 18*b* is comprised of two sections of fabric, 18*b*' and 18*b*". The two sections of fabric 18*b*', 18*b*" are arranged in such a way that a portion of one of the sections of fabric overlaps a portion of the other section of fabric. FIGS. 9A and 9B show that the first section 18*b*' overlaps the second section 18*b*" but it will be understood that in other embodiments the second section 18*b*" may overlap the first section 18*b*'. The first sections 18*b*' and 18*b*" are sewn to first layer 18*a* along their first and second edges 18*e*, 18*f* but the first and second sections 18*b*', 18*b*" are not sewn to one another along the region where they overlap one another. Because of this arrangement, an access opening 26 is defined between first section 18*b*' and second section 18*b*" in the overlapped region. The access opening 26 is in fluid communication with the interior compartment of the first leg 18. Similarly, as seen in FIG. 3, second layer 20*b* of second leg 20 includes a first section 20*b*' and a second section 20*b*" that overlap in a substantially identical manner to first section 18*b*' and second region 18*b*". An access opening 28 is defined between the overlapped region of the first section 20*b*' and second region 20*b*" and the access opening 28 is in fluid communication with interior compartment 20*g* of second leg 20.

Referring particularly to FIG. 3, and In accordance with another aspect of the present disclosure, first ends 16*c*, 18*c*, 20*c* of central region 16, first leg 18, and second leg 20 are generally aligned with one another along a same plane "P". The length "L1" of central region 16, as measured between first end 16*c* and second end 16*d*, is from about 12 cm (4.7 inches) up to about 12.25 cm (4.8 inches). The length "L2" of each of the first leg 18 and second leg 20 is from about 30 cm (11.8 inches) up to about 36 cm (14.2 inches). First leg 18 and second leg 20 are of substantially the same length "L2" as one another.

FIG. 3 shows pillow has a widest width "W1" measured between first side 18*e* of first leg 18 and first side 20*e* of second leg 20 proximate second ends 18*d*, 20*d* thereof The width "W1" is of about 58.5 cm (23 inches). As is evident from FIG. 3, the width of pillow 10 tapers from proximate second ends 18*d*, 20*d* of legs 18, 20 moving in a direction towards first ends 18*c* and 20*c* thereof. First end 18*c* and first side 18*e* meet one another and form a curved corner. Similarly, first end 20*c* and first side 20*e* meet one another and form a curved corner. The width of pillow 10 from one curved corner to the other along plane "P" indicated as "W2". Width "W2" is smaller than width "W1" and may be of about 34.5 cm (13.6 inches). It will, of course, be understood that pillow 10 may be fabricated in a range of different lengths and widths as desired.

FIG. 8 shows that central region 16 is of a substantially constant thickness "T1" when pads 14 are received within the interior compartments 18*g*, 20*g* of first leg 18 and second leg 20, respectively, and when pads 14 are removed from the interior compartments 18*g*, 20*g*. Each of the first leg 18 and second leg 20, by contrast, are of a thickness "T2", wherein the second thickness "T2" is much greater than the thickness "T1" of central region 16. The thickness "T2" is comprised of the thickness of pad 14 (measured between first surface 14*a* and second surface 14*b* plus the first wall 18*a*, 20*a* and second wall 18*b*, 20*b* of the respective one of the first leg 18, 20. Before pads 14 are introduced into the interior compartment of the respective legs 18, 20, central region 16, first leg 18, and second leg 20 will all be of relatively the same thickness "T1" that is equivalent to the combined thickness of the outer layer 12A of the shell 12 and the inner layer 12B of the shell. It will be understood that the thickness "T2" of pads 14 may be varied according to the type of "pillow feel" the manufacturer wishes to create in pillow 10. One suitable material for pad 14 is memory foam. A thicker, more rigid foam pad material will give a different pillow feel than a thinner, less rigid foam pad material. The stretchability of the fabric used for shell 12 will allow a range of different thickness pads 14 to be selectively inserted into shell 12.

In accordance with an aspect of the present disclosure, a closure tab 18*h* is provided on second side 18*f* of first leg 18. In particular, tab 18*h* is provided a short distance inwardly from second end 18*d* moving in a direction towards first end 18*c*. Similarly, a closure tab 20*h* is provided on second side 20*f* of second leg 20. Tab 20*h* is provided in a location on second leg 20 that is complementary to the location of tab 18 on first leg 18. Tabs 18 and 20 extend inwardly towards one another and each tab 18, 20 includes part of a mating fastener assembly 30 thereon. When the two parts of the fastener assembly 30 engage one another the two closure tabs 18*h*, 20*h* overlap and the fastener assembly 30 secures first leg 18 and second leg 20 to one another. If pillow 10 is worn on the parent's body, the engaged fastener assembly 30 ensures the pillow 10 won't accidentally slide off the parent's shoulders. Additionally, the first and second legs 18, 20 will be kept in a generally fixed orientation relative to one another during use and will not tend to slide towards one another or away from one another.

In accordance with another aspect of the present disclosure, each of the first leg 18 and second leg includes a loop member 32 thereon. Each of the loop members 32 is fixedly secured at one end to the associated first leg 18 and second leg 20. However, the second end of each loop member 32 may be releasably secured to the associated first leg 18 and second leg 20 a distance away from the fixed first end of the loop member 32. For example, the first end of each loop member 32 may be stitched to the respective first leg 18 and second leg 20 and the second end of each loop member 32 may be secured via a hook-and-loop fastener to the respective first leg 18 and second leg 20 a distance away from the first end thereof. Loop members 32 may be used to releasably secure objects to pillow 10. FIG. 10, for example, shows a soother 42 secured to pillow 10 by one of the loop members 32. In the illustrated instance, the second end of the loop fastener 32 will have been disengaged from the second leg 20, threaded through the handle region of the soother 42, and then the second end of the loop member 32 will have been reengaged with the second leg 20. Obviously, the soother 42 could have been engaged with the loop member 32 on the first leg 18 instead. When the soother 42 (or any other object) is engaged with loop member 32, the soother 42 is removably suspended from the loop member 32. The soother 42 is removed from loop member 32 by disengaging the second end of loop member 32 from the second leg 20, sliding the soother 42 off the loop member 32, and then reengaging the second end of the loop member with the second leg 20.

In accordance with yet another aspect of the present disclosure, an anti-slip region 34 is provided on the second layer 18*b*, 20*b* of the respective first leg 18 and second leg 20. The anti-slip region 34 in some embodiments comprises a length of a friction-increasing layer of fabric that is sewn or otherwise adhered or secured to second layer 18*b*, 20*b*. The anti-slip region 34 may be provided on a part of the second section 18*b*" or 20*b*" that is proximate second end 18*d*, 20*d*, respectively. The anti-slip regions 34 aid in preventing first leg 18 and second leg 20 from moving towards one another and away from one another on the body of the parent when pillow 10 is worn thereon.

As indicated earlier herein, pads 14 are engaged with shell 12 to form pillow 10. Each pad 14 is fabricated from a cushioning material. In one embodiment, each pad 14 may be comprised of a compressible foam material. Preferably the cushioning material of pads 14 is elastic and resilient. In other words, the foam material may be compressed when a child's head rests on first leg 18 or second leg 20 but the pad 14 will return to its original condition when the child's head is lifted off from first leg 18 or second leg 20.

FIGS. 2, 9A and 9B show that each pad comprises a first surface 14*a*, a second surface 14*b*, a first end 14*c*, a second end 14*d*, a first side 14*e*, and a second side 14*f*. The region of each pad 14 proximate the intersection of first surface 14*a* and second end 14*d* is skived to present a skived portion 14*g*. Skived portion 14*g* is shaved or otherwise formed to be oriented at an angle relative to first surface 14*a* and to second surface 14*b*. In one embodiment, skived portion 14*g* is oriented at an angle $\alpha$ (FIG. 9A) of about 45 degrees relative to top surface 14*a* and at a similar angle to bottom surface 14*b* of pad 14. Skived portion 14*g* may be arranged at any desired angle relative to first surface 14*a* and second surface 14*b*.

FIGS. 2, 9A, and 9B show one or more rows of stiches 36, 38 formed in pad 14 proximate first end 14*c* thereof. In particular, a first row of stitches 36 is formed in pad 14 a first distance inwardly from first end 14*c* of pad 14. The first row of stiches 36 extends from first side 14*e* of pad 14 to second side 14*f* thereof. Similarly, a second row of stitches 38 are formed in pad a second distance inwardly from first end 14*c* of pad 14 such that the first row of stitches 36 is located between first end 14*c* and second row of stitches 38. As is evident from FIGS. 9A and 9B, the rows of stitches 36, 38 compress the first surface 14*a* and second surface 14*b* inwardly towards one another. This arrangement gives pad 14 improved bendability about each of the two rows of stitches. The first row of stitches 36 creates a first bending zone in pad 14 and the second row of stitches 38 creates a second bending zone in pad 14.

Pads 14 are inserted into the respective interior compartment 18*g*, 20*g* through the access openings 26, 28 defined by first leg 18 and second leg 20 and may later be removed through said openings 26, 28. When pads 14 are inserted in the respective interior compartments 18*g*, 20*g*, the first and second bending zones created by first and second rows 36, 38 of stitches are located proximate first end 18*c* or 20*c* of first leg 18 and second leg 20, respectively. Furthermore, the skived portion 14*g* of each pad 14 is located proximate the respective second end 18*d* or 20*d* of first leg 18 and second leg 20. The stretchiness of the fabric of shell 12 helps the user insert pads 14 and correctly position them within the interior compartments 18*g*, 20*g* relatively easily. The pads 14 may be just as easily removed from their locations within the interior compartments 18*g*, 20*g* of shell 12. Since the fabric is washable, the user may remove pads 14 and then put the shell into the wash to launder the same, and will then reinsert the pads 14 into the clean shell 12. If pads 14 are losing their compressibility/comfortableness or the foam thereof has become too soiled, the pads 14 may be replaced. In some instances, the pads 14 themselves may be made of a material that is capable of being easily laundered. Pads 14 may then be washed with shell 12. Alternatively, pads 14 may be removed from shell 12, washed separately, and then be reengaged with shell 12.

It should be noted that when skived portion 14*g* of pad 14 is inserted into the associated interior compartment 18*g*, 20*g* of first leg 18, and second leg 20, the first layer 18*a*, 20*a* of the associated first leg 18 or second leg 20 will assume the configuration of the skived portion 14*g*. This can readily be seen in FIGS. 2, 9A and 9B. The angled front end of the first layer 18*a*, 18*b* is indicated by the reference number 40 in FIG. 1 and FIGS. 9A, 9B. This angled front end 40 helps to ensure that a child is able to be comfortably held against the parent's body because the angled front end 40 becomes almost vertically oriented when pillow 10 is engaged on the parent's body. This almost vertical orientation of angled front end 40 is shown in FIGS. 11 and 12.

When a parent wishes to support their child's head on a more comfortable surface than directly on the parent's body, the fastener assembly 30 will be disengaged so that the first leg 18 and second leg 20 are not secured to one another proximate their second ends 18*d*, 20*d*. The parent will then place the U-shaped pillow on their body such that the central region 16 is located behind the parent's neck, the first leg 18 is draped over the parent's right shoulder and onto their chest, and the second leg 20 is draped over the parent's left shoulder and onto their chest. The fastener assembly 30 is engaged to secure first closure tab 18*f* to second closure tab 20*f*, and thereby securing first leg 18 to second leg 20. FIGS. 10 and 11 show pillow 10 correctly positioned on the parent's body. FIG. 11 shows that the central region 16 and first leg 18 extend for a short distance beyond the parent's right shoulder and a short distance down an upper portion of the parent's back. It will be understood that second leg 20 will be similarly arranged relative to the parent's left shoulder. FIG. 11 further shows that the angled front end 40 of first leg 18 is oriented almost vertically when pillow 10 is worn. FIG. 10 shows that the pillow 10 drapes comfortably over the parent's shoulders and onto their chest. Pillow 10 encircles the parent's neck and covers a substantial portion of the parent's chest.

Once pillow 10 is comfortably engaged on the parent's body, the parent is able to lift the child and rest the child's torso and head on the first surface 18*a* of the first leg 18. The bending zones in pad 14 provided by the first row of stitches 36 and second row of stitched 38 (FIG. 9B) help the pillow 10 follow the curve of the parent's shoulder and provide a comfortable resting place for the head of an older child who is held in the parents arms. If the parent wishes to switch how the hold their child, the parent can quickly and easily rearrange the child's body and head so that they rest on the first layer 20*a* (FIG. 10) of the pillow 10 to what is illustrated in FIG. 12. The almost vertical orientation of the angled portion 40 of the first leg 18 (or second leg 20) helps to ensure that the child's body is kept in close contact with the parent's body while the child's head rests on pillow 10.

When the parent no longer needs to have the child rest their head on the pillow 10, the child is removed from the parent's arms in any suitable fashion and the pillow is removed from being worn on the parent's body. This is accomplished by disengaging the fastener assembly 30, separating first leg 18 from second leg 20, and lifting the pillow 10 from around the parent's neck.

If it is determined the pillow is soiled and the shell 12 requires laundering, the pillow 10 is flipped to the position shown in FIG. 4, and the pads 14 are removed from first leg 18 and second leg 20 through the respective access openings 26, 28. Shell 12 is then thrown in the laundry and once cleaned and dried, pads 14 are reinserted into first leg 18 and second leg 20 through the access openings 26, 28, respectively. As indicated earlier herein, pads 14 may be replaced at any desired time by removing a first set of pads 14 from first leg 18 and second leg 20 through access openings 26, 28, and then inserting a replacement set of pads into first leg 18, and second leg 20 through the respective access openings 18, 20.

It will be understood that in other embodiments, pads 14 may be permanently enclosed within the compartments 18*g*, 20*g* of first leg 18 and second leg 20. This permanent arrangement is less desirable from the aspect of keeping the shell 12 and pads 14 clean.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A pillow for supporting a child's head while the child is held by a caregiver, said pillow comprising:

a shell that is U-shaped;

a first compartment defined by a first region of the shell;

a first pad or filler material provided in the first compartment, wherein the first compartment and first pad or filler material comprises a first leg of the pillow;

a second compartment defined by a second region of the shell;

a second pad or filler material provided in the second compartment, wherein the second compartment and the second pad or filler material comprises a second leg of the pillow;

a central region interposed between the first leg and the second leg;

wherein the central region originates proximate a first end of each of the first leg and the second leg and extends longitudinally towards a second end of each of the first leg and the second leg;

wherein the central region extends longitudinally for about one third of a total length of each of the first leg and the second leg, wherein the total length is measured between the respective first end and second end; and wherein the central region is free of any pad or filler material.

2. The pillow according to claim 1, wherein the central region comprises a first layer and a second layer that are opposed to one another, wherein the first layer comprises the upper surface of the shell and the second layer comprises the lower surface of the shell.

3. The pillow according to claim 1, wherein the central region comprises a first layer and a second layer that are located in abutting contact with one another.

4. The pillow according to claim 1, wherein the central region comprises a first layer and a second layer; wherein a cavity is defined between an interior surface of the first layer and an interior surface of the second layer, and the cavity is empty.

5. The pillow according to claim 1, wherein the first leg and the second leg are substantially equal in total length and extend beyond the central region in generally a same direction.

6. The pillow according to claim 1, wherein the shell has a shell first end extending along the first ends of the first leg and the second leg; and a shell second end opposed to the shell first end, wherein the shell second end extends along the second ends of the first leg and the second legs; and wherein the shell tapers in width moving longitudinally in a direction from the shell second end and towards the shell first end.

7. The pillow according to claim 1, wherein the first leg has an inner end, the central region has an inner end, and the second leg has an inner end, and the inner ends of the first leg, central region, and second leg are substantially continuous and bound and define a gap, and wherein the pillow includes a first closure member provided on the first leg adjacent the inner end thereof and extending into the gap; and a second closure member is provided on the second leg adjacent the inner end thereof and extending into the gap; and wherein the first closure member and second closure member operatively engage one another to secure the first leg and second leg to one another.

8. The pillow according to claim 1, wherein each of the first leg and the second leg has a first surface and a second surface opposed to the first surface, and wherein the second surface is adapted to contact a body of the caregiver wearing the pillow, and wherein a portion of the second surface of one or both of the first leg and the second leg includes a friction-increasing region.

9. The pillow according to claim 1, further comprising a loop member provided on one of the first leg and the second leg, wherein the loop member is adapted to selectively secure an object to the pillow.

10. The pillow according to claim 1, wherein the first pad or filler material and the second pad of filler material is removably received within the respective one of the first compartment and the second compartment.

11. The pillow according to claim 1, wherein the first pad or filler material and the second pad or filler material comprises a foam pad having a first surface and a second surface opposed to the first surface; a first end and a second end opposed to the first end and extending between the first surface and second surface, wherein the first end and second end define a longitudinal direction therebetween; and wherein one or both of the first surface and the second end are skived to form an angular portion.

12. The pillow according to claim 11, wherein the angular portion is arranged at an angle of about 45° relative to the second surface of the foam pad.

13. The pillow according to claim 11, wherein wherein the foam pad further comprises a first side and a second side extending between the first surface and the second surface and defining a lateral direction therebetween; and wherein the foam pad further comprises at least one row of stitching that extends from the first side to the second side of the foam pad and reduces a distance between the first surface and the second surface.

14. The pillow according to claim 13, wherein the at least one row of stitching comprises a first row of stitching disposed a distance away from the first end of the foam pad; and wherein the first row of stitching forms a first bending zone of the foam pad.

15. The pillow according to claim 14, wherein the at least one row of stitching further comprises a second row of stitching disposed a distance away from the first row of stitching moving in a direction away from the first end of the foam pad and towards the second end of the foam pad; and wherein the second row of stitching forms a second bending zone of the foam pad.

16. A method of supporting a child's head while the child is being held by a caregiver, said method comprising:

providing the pillow according to claim 1;

placing the pillow on the caregiver's body by placing a second end of the central region behind the caregiver's neck;

extending the first leg of the pillow over a first shoulder of the caregiver's body;

extending the second leg of the pillow over a second shoulder of the caregiver's body;

extending the first leg and the second leg downwardly over portions of the caregiver's chest in such a way that the first leg is laterally spaced from the second leg;

engaging a first closure member on the first leg with a second closure member on the second leg such that a gap between a lowermost end of the first leg and a lowermost end of the second leg is reduced; and placing a head of the child on one or the other of the first leg and the second leg.

17. The method according to claim 16, further comprising: draping an uppermost end of the pillow over the caregiver's first and second shoulders in an opposite direction to the direction in which the first leg and the second leg extend.

18. The method according to claim 16, further comprising: contacting a portion of the caregiver's body with a non-slip surface provided on one or both of the first leg and the second leg.

19. The method according to claim 16, further comprising:

removably suspending an object from a loop member provided on one of the first leg and the second leg.

20. The pillow according to claim 1, further comprising:

a first connection region provided between the first leg and a first side of the central region, wherein the first connection region is oriented at right angles to the first end of the first leg and extends longitudinally along an upper surface of the shell.

21. The pillow according to claim 20, further comprising:

a second connection region provided between the second leg and a second side of the central region, wherein the second connection region is oriented at right angles to the first end of the second leg and extends longitudinally along the upper surface of the shell.

22. The pillow according to claim 20, wherein the first connection region and the second connection region are laterally spaced apart from one another and extend between the upper surface and a lower surface of the shell.

23. The pillow according to claim 22, wherein the first connection region and the second connection region each comprise a line of stitches that extend longitudinally along the upper surface of the shell.

* * * * *